US005553735A

United States Patent [19]

Kimura

[11] Patent Number: 5,553,735

[45] Date of Patent: Sep. 10, 1996

[54] VESSEL WITH DISPLAY FUNCTION

[76] Inventor: Fumiyo Kimura, 1-804 Komiya-cho, Hachioji-city, Tokyo, Japan

[21] Appl. No.: 208,340

[22] Filed: Mar. 8, 1994

[51] Int. Cl.[6] ..... B65D 25/54

[52] U.S. Cl. ..... 220/469; 220/410; 220/420; 220/662; 40/324

[58] Field of Search ..... 220/420, 425, 220/469, 622, 410, 209, 662; 215/12.1; 40/324

[56] References Cited

U.S. PATENT DOCUMENTS

| | | | |
|---|---|---|---|
| 4,210,255 | 7/1980 | Pan | 220/209 |
| 4,473,161 | 9/1984 | Zimmerman | 220/420 X |
| 4,789,073 | 12/1988 | Fine | 220/410 X |
| 4,928,412 | 5/1990 | Nishiyama | 40/324 |
| 4,979,325 | 12/1990 | White | 40/324 X |
| 5,036,998 | 8/1991 | Dunn | 220/469 |
| 5,040,317 | 8/1991 | Kadjevich | 220/662 X |
| 5,339,548 | 8/1994 | Russell | 40/324 |

*Primary Examiner*—Steven M. Pollard
*Attorney, Agent, or Firm*—Thomas M. Freiburger

[57] ABSTRACT

A vessel for holding a liquid includes an outer shell and an inner shell and means connecting the outer and inner shell, the outer shell and inner shell forming a cavity between them. At least the outer shell is of optically transparent material. The cylindrical cavity between the shells is capable of storing decorations or information visible from the exterior of the vessel, and these decorations or information can be selected by the user and changed by the user as desired, by opening the cavity.

6 Claims, 9 Drawing Sheets

VESSEL WITH DISPLAY FUNCTION

BACKGROUND OF THE INVENTION

The present invention relates to vessels and in particular relates to a vessel with a cavity for displaying decorative or informative items and means for opening and closing the cavity. The vessel can be used to hold something inside, as in a drinking vessel, and also to display decorations and/or information on its surface.

Decorations and/or information are usually painted or printed on the surface of a vessel directly. If the vessel is used for a long time, a user's interest in the decorations on the vessel may be lost. If the vessel has information printed on its surface, that information may become out of date with time.

For a vessel hitherto conventionally used, it is very difficult or almost impossible to change its decoration and/or information. A vessel is often disposed of because of the outdated decorations and/or information on its surface, even though the vessel still has the capability to hold something. For a vessel conventionally used, it is impossible to use liquid, three-dimensional objects or powder as the decoration of the vessel.

SUMMARY OF THE INVENTION

It is an object of the present invention to provide a vessel which makes possible the easy and free exchange of decoration and/or information in a vessel by an individual user.

Another object of the invention is to provide a vessel which makes it possible to use three-dimensional objects, liquid, powder, mechanical items or electronics as decorations of a vessel. If decoration and/or information of a vessel are easily and freely exchanged, the vessel will always have a fresh appearance or message. The user will be less likely to dispose of and replace the outdated vessel, thereby contributing to conservation of natural resources and not contributing to environmental pollution.

The vessel disclosed has at least an outer shell, an inner shell and connection means between the outer and inner shells. The outer shell and inner shell form a cavity in which decorations and/or information can be stored. In one embodiment a connection means which connects the outer shell and the inner shell is capable of being connected or disconnected by hand, without any special tools. The outer shell and inner shell can be made either of the same material or different materials. In another embodiment the outer and inner shells are permanently connected on integral, but another component of the vessel is removably connected so as to give access to the cavity between the outer and inner shells when removed.

The cavity in a preferred embodiment is opened by connection or closed by disconnection of the shell. Simple mechanical connecting methods are widely used for the vessel, such as screw, hinge, insertion, etc. Either the outer shell, an inner shell or both are made of optically transparent materials such as plastic and glass.

Decorations and/or information are visible through the shell from outside or inside. The inner shell is used as a conventional vessel to hold something inside, as a drinking vessel, for example. The cavity can be sealed by a sealing pad or filter that allows air to pass but not liquid.

Two dimensional objects such as painted pictures, printed matter, pieces of colored paper, pieces of cloth, plastic films, metal films and so on can be stored in the cavity as decorations and/or information.

Three-dimensional objects such as dried flowers, small stones, pieces of metal, glass, ceramics, plastic, wood, leaves and so on can be also stored in the cavity.

In addition, various types of granular or powder substances such as sand, flour, metal powder and so on can be stored in the cavity.

Liquids, for example colored water, can also be stored in the cavity.

An electrical display including illumination can be stored in the cavity, including a sensor, driving circuit and batteries.

Mechanical items can also be stored in the cavity. Decorations and/or information may have a movement driven by electrical and/or mechanical means.

DESCRIPTION OF PREFERRED EMBODIMENTS

Figure 1:
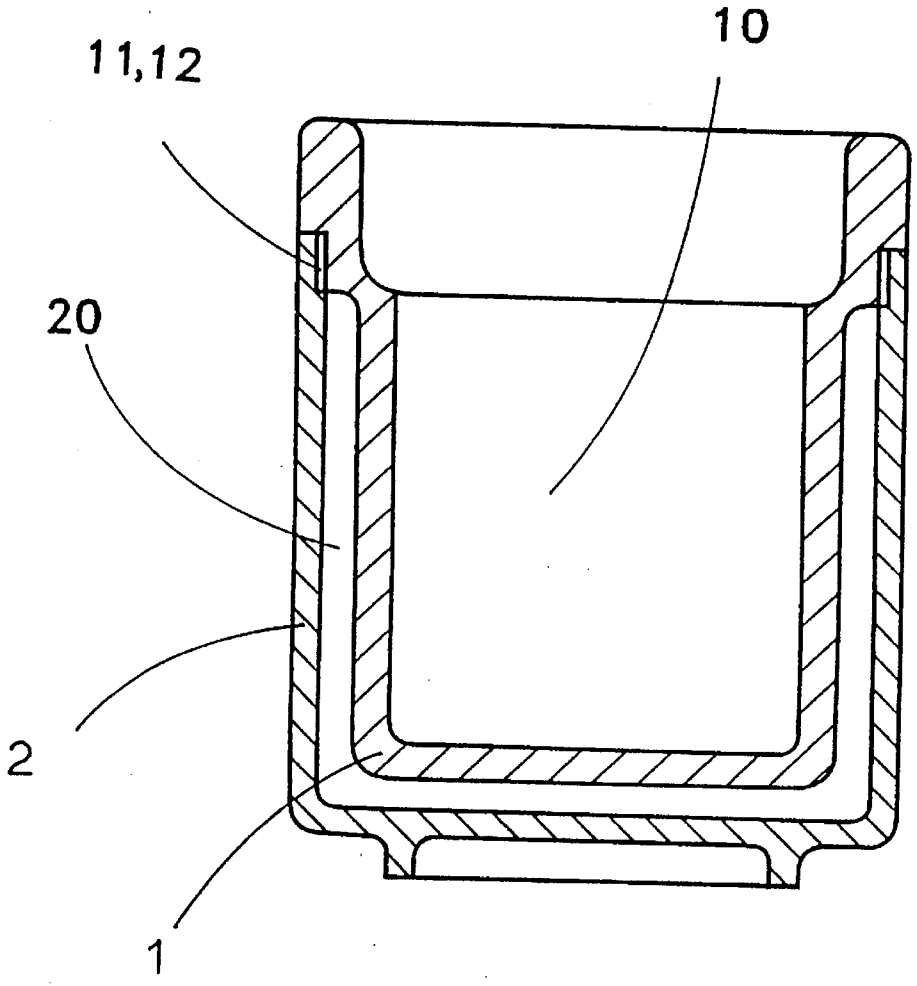
FIG. 1 is a vertical sectional view of a preferred embodiment of this invention.

In FIG. 1, an inner shell 1 is formed, for example, with plastic material by injection molding and has a concave area 10 which functions as a conventional vessel. An outer shell 2 is formed with optically transparent plastic material by injection molding. A screw connector 12 of outer shell 2 fits into a screw connector 11 of inner shell 1 at connection means 11, 12 to form a cavity 20.

Figure 2:
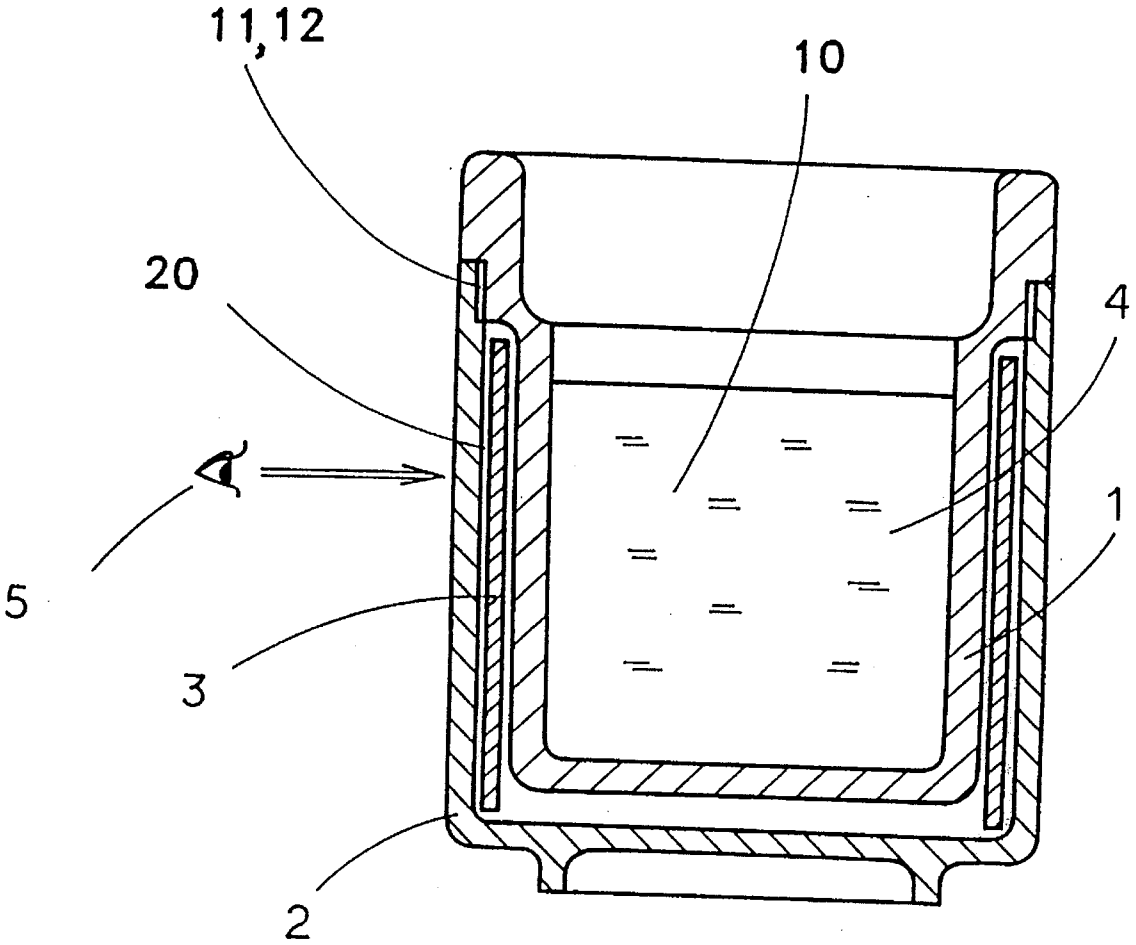
FIG. 2 is a vertical sectional view of the embodiment of FIG. 1, in use.

FIG. 2 shows the embodiment of FIG. 1 in use, with a decorative object 3 stored in the cavity 20 and a liquid 4, which may be a beverage such as coffee or tea, held in the concave area 10 of the inner shell. The decorative object 3 can be seen through the transparent outer shell 2. The decorative object 3 can be easily exchanged for a different decorative object by disconnecting the connection 11, 12. This operation can be completed by hand without tools.

A decorative object 3 may also be stored in the cavity 20 so that it can be viewed through a transparent inner shell 1. The decorative object 3 can be seen through the liquid 4. In FIG. 2 the concave area 10 of the inner shell has the shape and depth of a cup. The concave area 10 of the inner shell may also be deeper, such as for a vase, or shallower as for a dish.

Figure 3:
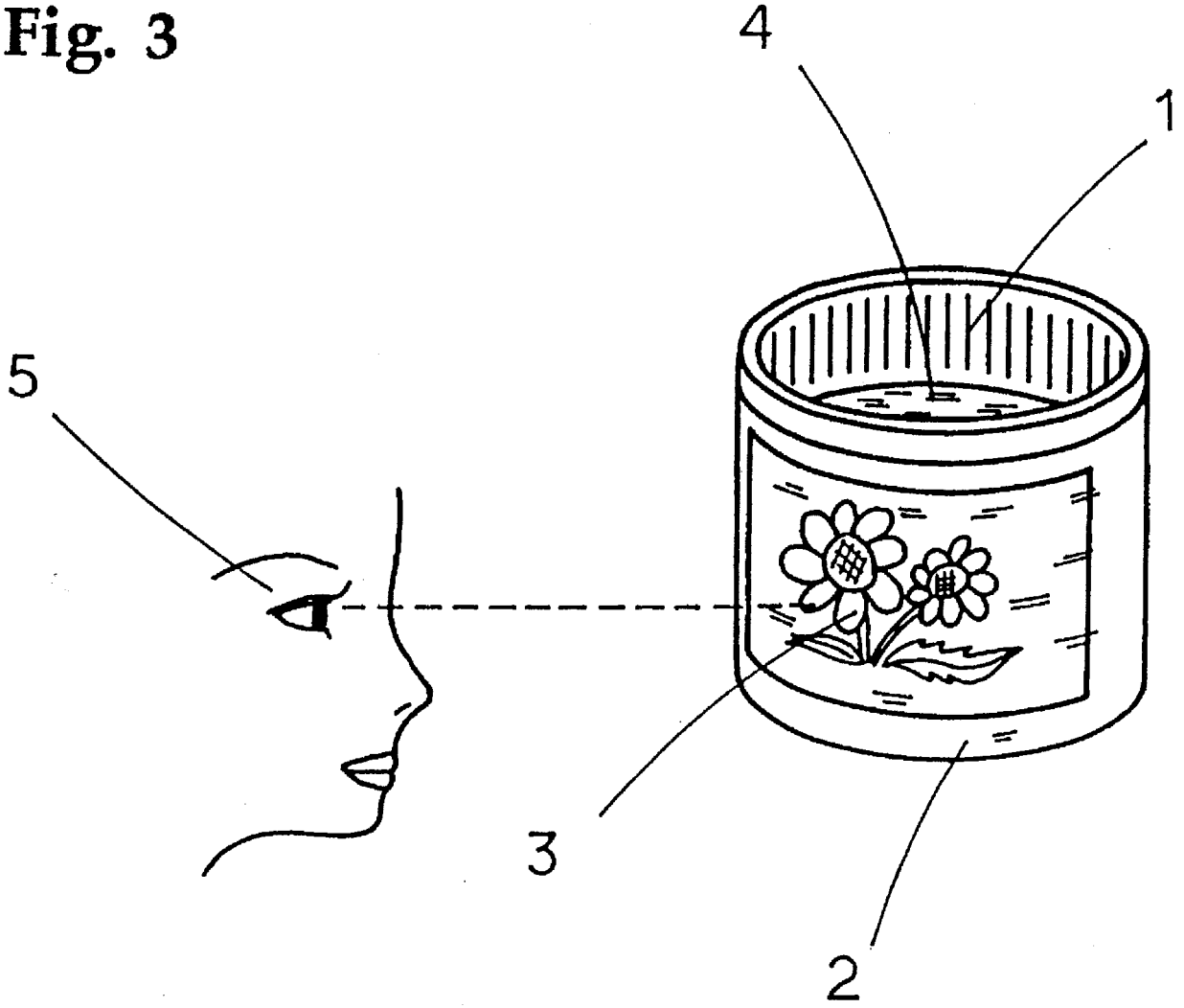
FIG. 3 is a perspective view according to FIG. 2.

FIG. 3 is a perspective view of FIG. 2 in which the decorative object 3 is a photograph or picture of flowers which can be seen by the eye 5 through the outer shell 2. Liquid 4 is held within the concave area 10 of the inner shell 1.

Figure 4:
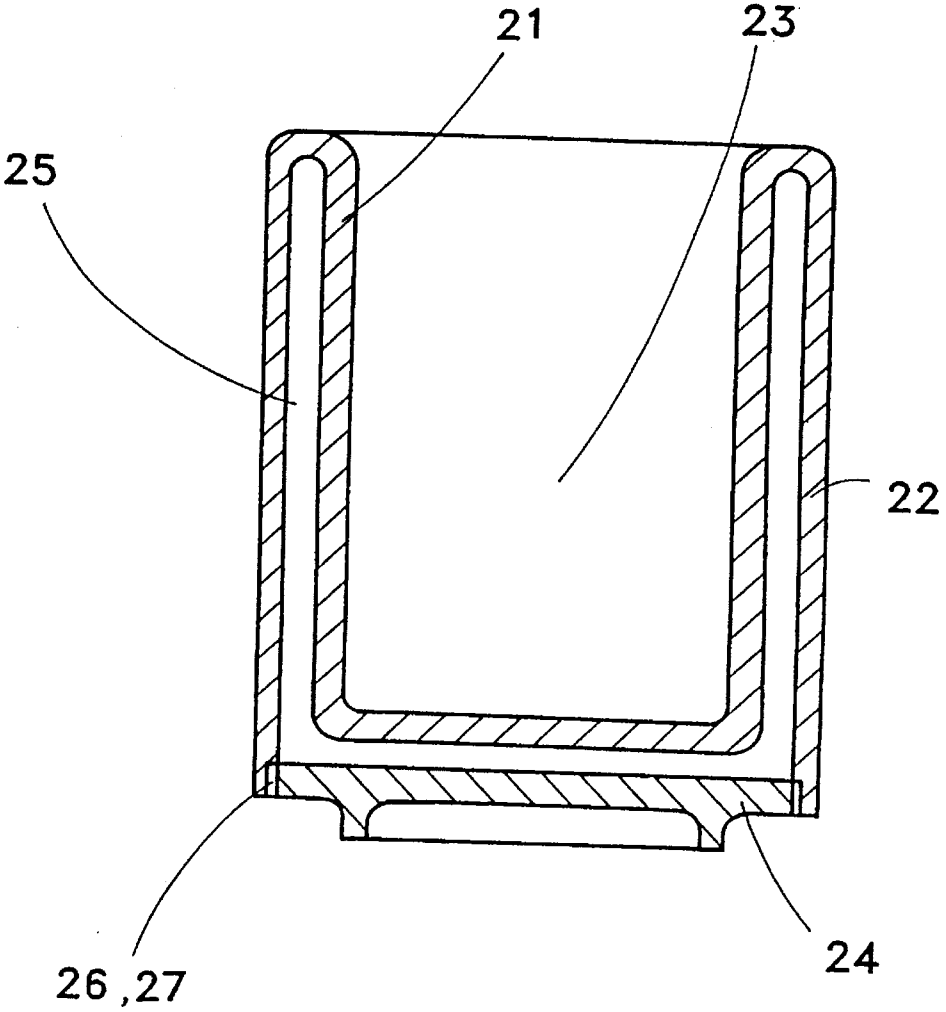
FIG. 4 is a vertical sectional view of another preferred embodiment of the invention.

FIG. 4 shows another preferred embodiment of the invention in which an inner shell 21 and an outer shell 22 are formed integrally. A concave area 23 is defined by the inner shell 21. A bottom closure piece 24 opens and closes for access to a cavity 25, formed between the inner shell 21 and the outer shell 22, for insertion of decorations and/or information. The bottom closure piece 24 has a bottom closure connection comprising screw threads 26, 27. The bottom closure connection 26, 27 connects outer wall 22 to bottom piece 24. In this embodiment, the integral shell 21, 22 is formed of a transparent material so that it is possible to view the decorations and/or information within the cavity 25 through both the inner shell 21 and the outer shell 22.

Figure 5:
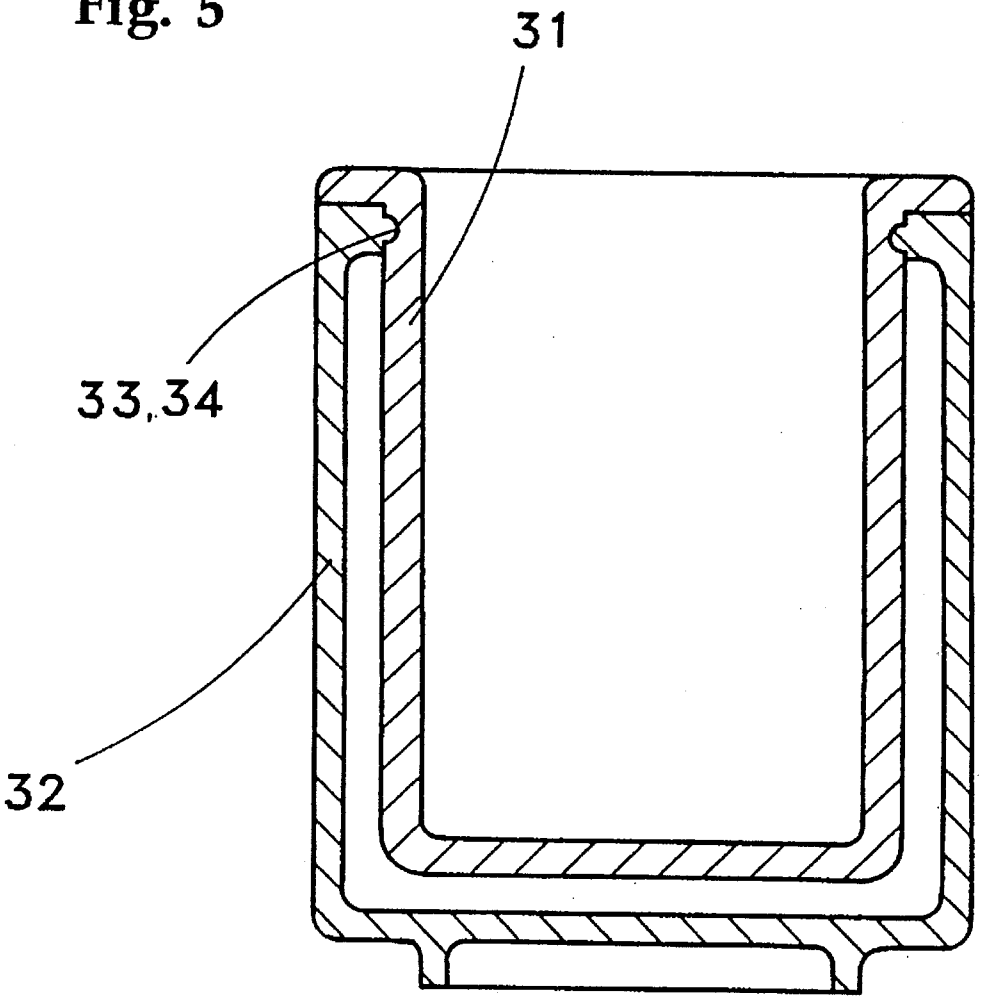
FIG. 5 is a vertical sectional view of a further preferred embodiment of the invention in which a connection is made by an insertion.

FIG. 5 shows a further preferred embodiment of this invention, similar to FIG. 1. In this embodiment an inner shell 31 is connected to an outer shell 32 by press-fit insertion means 33, 34.

Figure 6:
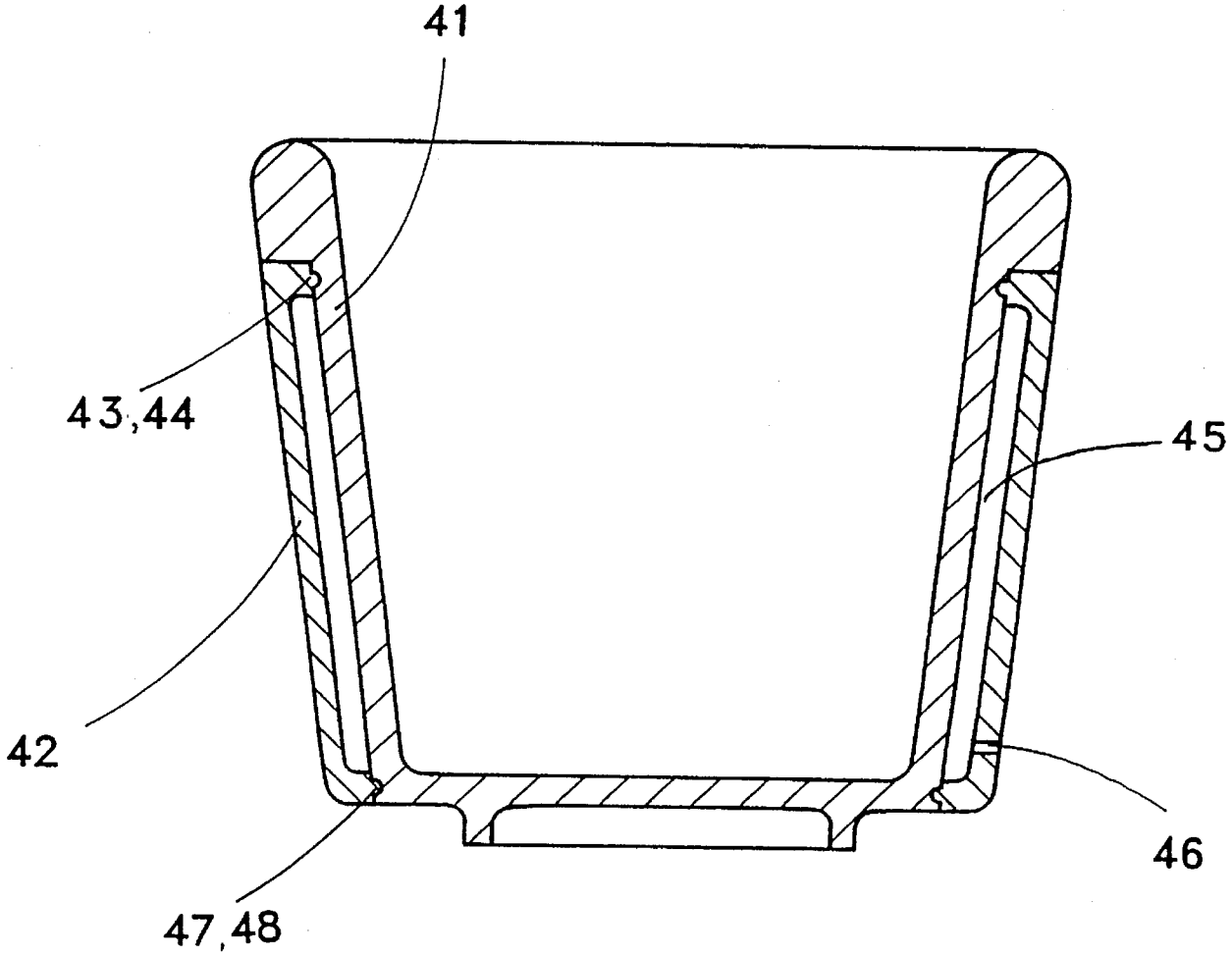
FIG. 6 is a vertical sectional view of a further preferred embodiment of the invention, similar to FIG. 5.

FIG. 6 shows a further preferred embodiment of this invention, similar to FIG. 5. An inner shell 41 is connected by press-fit insertion to an outer shell 42 with two sets of connection means 43, 44 and 47, 48. Included in this embodiment is a small hole 46 in the outer shell 42 for releasing pressure within the cavity 45 which may be caused by temperature changes that can potentially damage shells 41 and 42.

Figure 7:
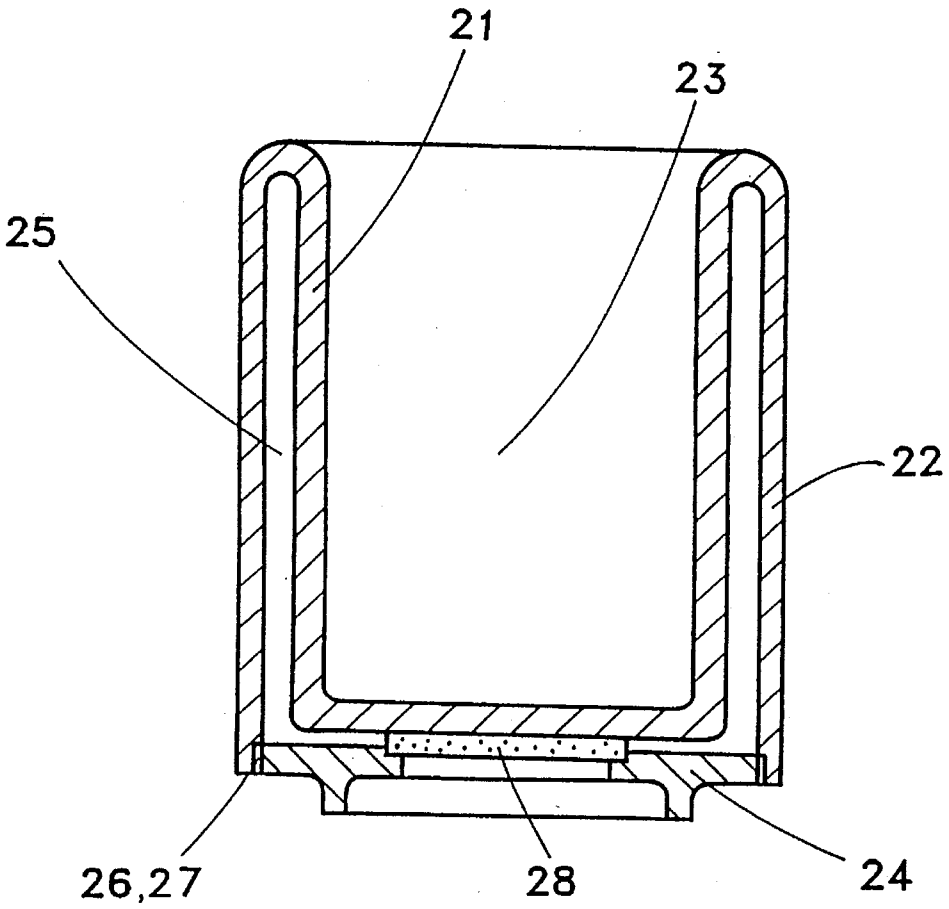
FIG. 7 is a vertical sectional view of a further preferred embodiment of the invention, similar to FIG. 4, which includes a venting filter.

FIG. 7 shows the embodiment of FIG. 4 with a venting filter 28 is included in this embodiment which prevents passage of liquid but allows air passage between the cavity 25 and the outside atmosphere. The venting filter 28 can release pressure caused by environmental temperature changes, thus preventing damage to the integral shell 21, 22 and the bottom piece 24. If the vessel is exposed to liquids or moisture, the venting filter 28 will prevent liquid or moisture from entering the cavity 25.

Figure 8:
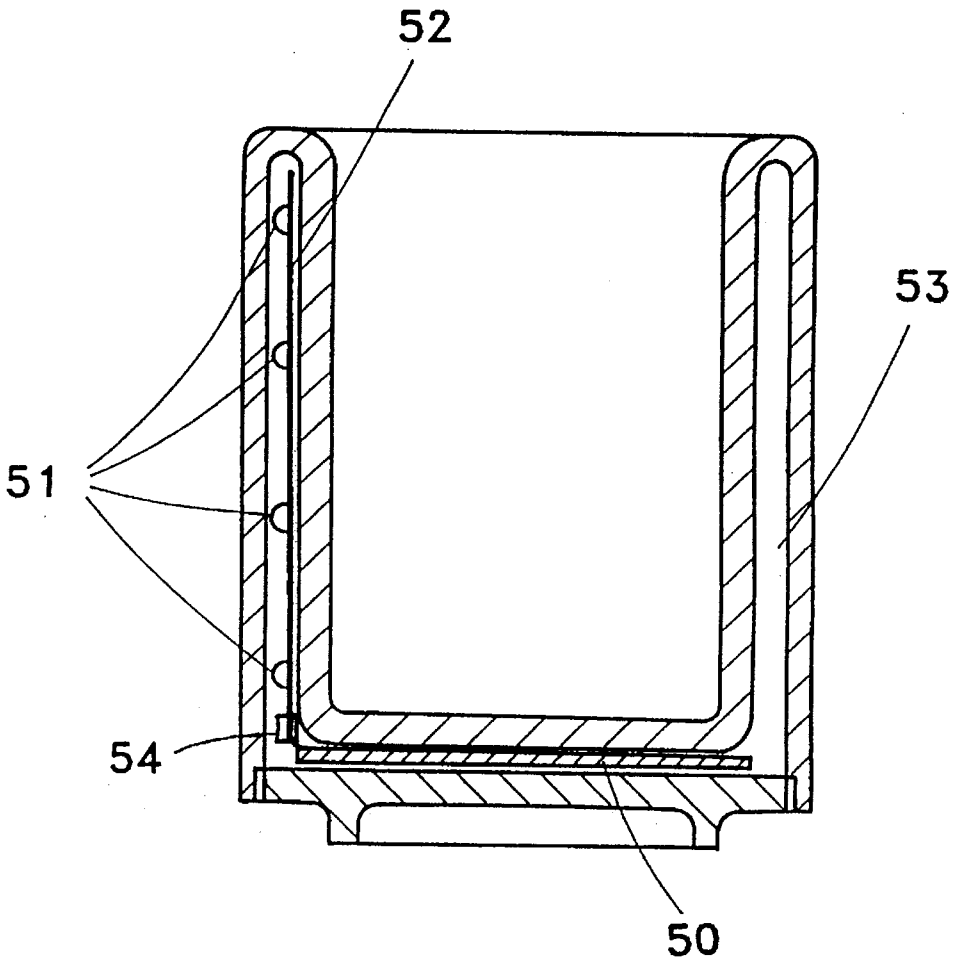
FIG. 8 is a vertical sectional view of a further preferred embodiment of the invention, similar to FIG. 4, which includes an electrical drive circuit and a power supply.

FIG. 8 shows a further preferred embodiment of this invention similar to FIG. 4 in which the decorations inserted into the cavity comprise small light sources 51 which may be, for example, light bulbs, light emitting diodes or laser diodes. A flexible circuit 52 connects an electrical drive circuit, a sensor 54 and power supply 50, which may be a battery cell, to the light sources 51. The light sources 51 may be switched on and off with the sensor in the cavity 53.

A combination of light sources and optical elements may also be used as decoration and/or information. Various kinds of electrical imaging display panels, such as plasma display panels, CRT displays, liquid crystal displays and photo luminescent panels can be used as decoration and/or information. Numerical information such as time and temperature can also be displayed on electrical imaging display panels.

Figure 9:
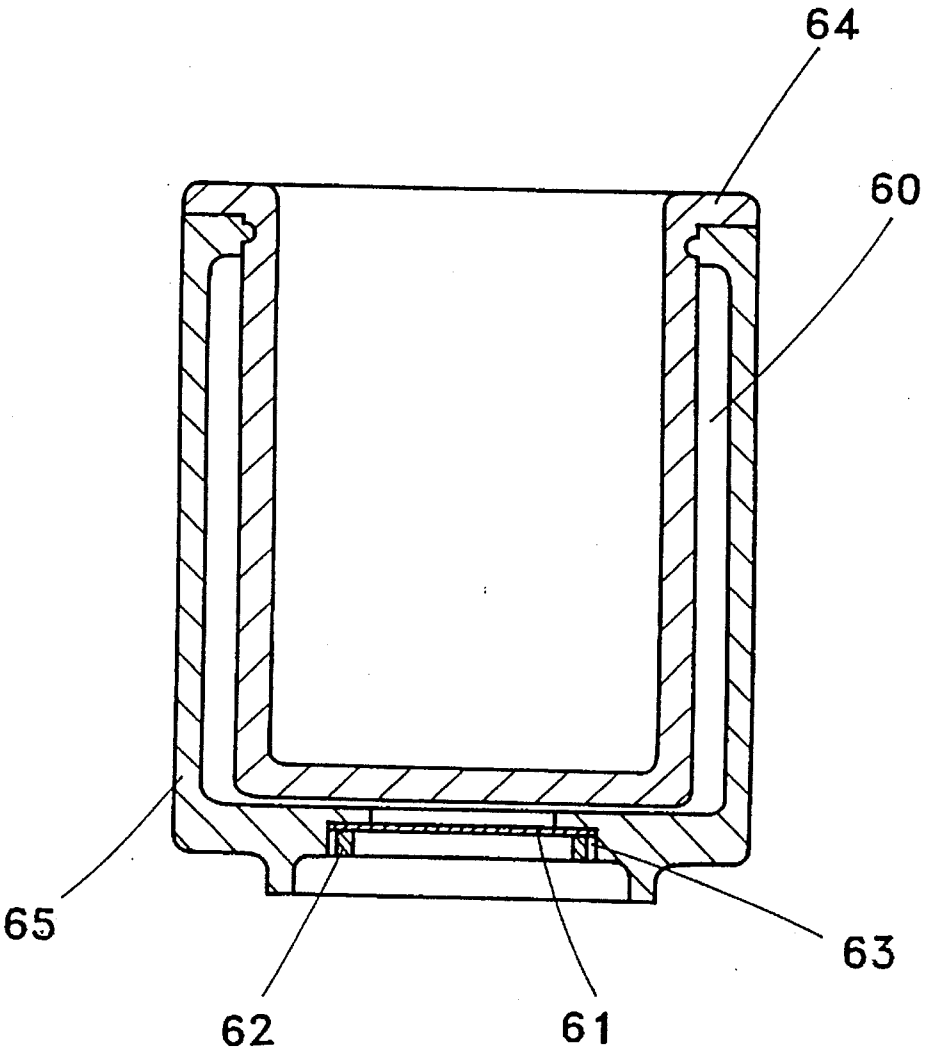
FIG. 9 is a vertical sectional view of a further preferred embodiment of the invention, similar to FIGS. 5 and 6.

FIG. 9 shows a further preferred embodiment of this invention similar to FIG. 5 in which a cavity 60 formed by an inner shell 64 and an outer shell 65 is completely sealed. When pressure in the cavity 60 is increased or decreased by environmental temperature change, a flexible membrane 61 can absorb pressure change in the cavity 60. A support member 62 is fixed by a screw connection means 63 to outer shell 65.

Not shown in the drawings are treatments of the interior surfaces of the various cavities to prevent mold, static and moisture condensation from forming.

Although the invention has been particularly shown and described, it is contemplated that various changes and modification may be made without departing from the scope of the invention as set forth in the following claims.

I claim:

1. A vessel comprising an outer shell, an inner shell and means connecting the outer and inner shell, said outer shell and inner shell forming a cavity between them, at least said outer shell being of optically transparent material, the cavity being capable of storing decorations or information and including removable cavity closing means for sealing the cavity, and further including a venting filter means positioned between the cavity and the exterior of the vessel, for passing air but not water, for equalizing pressure between the sealed cavity and the exterior.

2. A vessel according to claim 1, wherein the cavity contains electrical components as decoration, positioned so as to be visible through the outer shell.

3. A vessel according to claim 2, including electric light sources or electric imaging displays position in the cavity as said decoration, and including a battery and sensor means connected to switch on and off the light sources or electric imaging display.

4. A vessel according to claim 3, including a combination of said light sources and optical elements in the cavity as said decoration.

5. A vessel according to claim 1, wherein the outer shell and the inner shell are integrally formed together as an integral shell, serving as said means for connecting the outer and inner shell, with a bottom opening in the outer shell, and wherein said removable cavity closing means includes a removable bottom closure with means for attachment over the bottom of the outer shell, to close the cavity.

6. A vessel according to claim 5, wherein the removable cavity closing means includes screw thread means for securing the bottom closure to the outer shell.

* * * * *